US009232823B2

(12) United States Patent
Mitchell et al.

(10) Patent No.: US 9,232,823 B2
(45) Date of Patent: Jan. 12, 2016

(54) BAND FOR GARMENT

(71) Applicant: HBI Branded Apparel Enterprises, LLC, Winston-Salem, NC (US)

(72) Inventors: John Mitchell, High Point, NC (US); Heinz Altman, Winston-Salem, NC (US)

(73) Assignee: HBI Branded Apparel Enterprises, LLC, Winston Salem, NC (US)

( * ) Notice: Subject to any disclaimer, the term of this patent is extended or adjusted under 35 U.S.C. 154(b) by 335 days.

(21) Appl. No.: 13/833,306

(22) Filed: Mar. 15, 2013

(65) Prior Publication Data

US 2014/0259304 A1 Sep. 18, 2014

(51) Int. Cl.

| | |
|---|---|
| ***A41B 9/00*** | (2006.01) |
| ***A41C 3/00*** | (2006.01) |
| ***D04B 1/10*** | (2006.01) |
| ***D04B 1/24*** | (2006.01) |

(52) U.S. Cl.

CPC ..... *A41C 3/0057* (2013.01); *A41B 9/001* (2013.01); *D04B 1/106* (2013.01); *D04B 1/24* (2013.01)

(58) Field of Classification Search

CPC ..... A41C 3/00; A41C 1/00
USPC ..... 450/64–67, 70, 74–76, 78, 81, 82, 92, 450/93

See application file for complete search history.

(56) References Cited

U.S. PATENT DOCUMENTS

| | | | | |
|---|---|---|---|---|
| 1,863,697 | A | | 6/1932 | Rutledge |
| 2,171,236 | A | | 8/1939 | Getaz |
| 2,974,508 | A | | 3/1961 | Westmoreland |
| 3,338,071 | A | | 8/1967 | Pons et al. |
| 3,408,833 | A | | 11/1968 | Frederick et al. |
| 3,602,012 | A | | 8/1971 | Burleson |
| 3,729,956 | A | | 5/1973 | Nebel et al. |
| 3,760,611 | A | | 9/1973 | Duckworth |
| 3,908,711 | A | | 9/1975 | Goff, Jr. et al. |
| 3,956,906 | A | | 5/1976 | Cassidy, Sr. |
| 4,034,580 | A | | 7/1977 | Holder |
| 4,412,433 | A | | 11/1983 | Safrit et al. |
| 4,722,202 | A | | 2/1988 | Imboden |
| 4,852,188 | A | | 8/1989 | Marsh et al. |
| 4,872,324 | A | | 10/1989 | Rearwin et al. |
| 5,280,652 | A | | 1/1994 | Davis et al. |
| 5,533,468 | A | * | 7/1996 | Sampson et al. ..... 119/524 |
| 5,561,861 | A | | 10/1996 | Lopez et al. |
| 6,125,664 | A | | 10/2000 | Browder, Jr. |
| 6,550,288 | B2 | | 4/2003 | Browder, Jr. et al. |

(Continued)

FOREIGN PATENT DOCUMENTS

| | | |
|---|---|---|
| GB | 2386382 | 9/2003 |

OTHER PUBLICATIONS

International Search Report and Written Opinion dated Sep. 19, 2014 in PCT/US2014/022374.

(Continued)

*Primary Examiner* — Gloria Hale
(74) *Attorney, Agent, or Firm* — Fish & Richardson P.C.

(57) ABSTRACT

An upper torso garment and a lower torso garment each comprising a respective torso encircling band. The band includes an inner layer and an outer layer with each layer having a first series of courses. The first series of courses defined by a first, covered elastomeric, yarn and a second, low friction, yarn. The first and second yarns are knit such that the second yarn is float platted with the first yarn.

20 Claims, 3 Drawing Sheets

(56) References Cited

U.S. PATENT DOCUMENTS

| | | | | |
|---|---|---|---|---|
| 6,622,312 | B2 * | 9/2003 | Rabinowicz | 2/401 |
| 6,708,530 | B2 | 3/2004 | Mitchell | |
| 6,871,516 | B2 | 3/2005 | Peeler et al. | |
| 2003/0230123 | A1 * | 12/2003 | Weinraub | 70/49 |
| 2004/0014394 | A1 * | 1/2004 | Mitchell et al. | 450/65 |
| 2006/0021388 | A1 * | 2/2006 | Mitchell et al. | 66/176 |
| 2006/0150302 | A1 * | 7/2006 | Warren et al. | 2/400 |
| 2014/0248822 | A1 * | 9/2014 | Abbott et al. | 450/1 |
| 2014/0259304 | A1 * | 9/2014 | Mitchell et al. | 2/400 |

OTHER PUBLICATIONS

PCT Written Opinion of the International Preliminary Examining Authority, PCT/US2014/022374, Mar. 20, 2015, 7 pages.

PCT International Preliminary Report on Patentability, PCT/US2014/022374, Jun. 18, 2015, 15 pages.

* cited by examiner

BAND FOR GARMENT

FIELD OF THE INVENTION

The present disclosure generally relates to apparel, particularly undergarments and hosiery. More particularly, the present disclosure relates to a band knitted with undergarments or hosiery.

BACKGROUND OF THE INVENTION

Bands, often with some degree of elasticity, are included in garments to provide comfort and support. Elastic bands have been applied to the top of stockings to hold the stocking in place along the leg. Elastic bands are used to encircle the waist, supporting briefs or full length hosiery. Bands have also been used along the bottom of brassieres, particularly sports bras, anchoring the bra to the chest.

Commonly, these bands, and the garment they are associated with, are integrally formed on a circular knitting machine. These circular knitting machines create a knitted tube that can be closed off at one end, to create stockings, for example. Using a circular knitting machine, elastic bands have been formed using a turned welt construction. In a turned welt, the knitted tube is turned inside or folded outwardly upon itself, to form a two-ply fabric construction at the welted portion. Alternatively, elastomeric bands may be separately sewn or otherwise stitched onto the top portion of a brief/panty or the lower edge of a brassiere.

In order to improve the ability for the prior art bands to be held in place relative to the body, bare rubber yarns have been stitched into the band. For example, it is known to use, an outwardly turned welt to form the top band of a stocking. On the inside of the stocking, to be placed adjacent to the skin, a non-slip elastic yarn, such as bare rubber, may be used.

SUMMARY OF THE INVENTION

The present invention is directed to a band construction that provides improved comfort for the wearer, by providing a band free of exposed bare elastomer, having reduced bulk, while maintaining a sufficiently tight fit to provide the desired control for the garment.

A first aspect of this disclosure is an upper torso garment such as a brassiere. The upper torso garment is formed having a pair of shoulder straps, a back, and a front that forms at least one breast covering and supporting portion. The upper torso garment further comprises a band integrally formed below the at least one breast covering portion. The band is constructed having at least a first series of courses that include a first, covered elastomeric yarn and a second, low friction yarn, the second yarn being float platted with the first yarn.

A second aspect of this disclosure is a lower torso garment. The lower torso garment comprises a body portion defining a crotch area and pair of leg openings. The leg openings may or may not be attached to a pair of leg portions. The top, waist encircling end of the lower torso garment further comprises a band. The band is constructed having at least a first series of courses that include a first, covered elastomeric yarn and a second, low friction yarn, the second yarn being float platted with the first yarn.

These and other aspects of the present invention will become apparent to those skilled in the art after a reading of the following description of the preferred embodiments, when considered in conjunction with the drawings. It should be understood that both the foregoing general description and the following detailed description are exemplary and explanatory only and are not restrictive of the invention as claimed.

BRIEF DESCRIPTION OF THE DRAWINGS

The foregoing and still other objects and advantages of the present invention will be more apparent from the following detailed explanation of embodiments of the invention in connection with the accompanying drawings.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
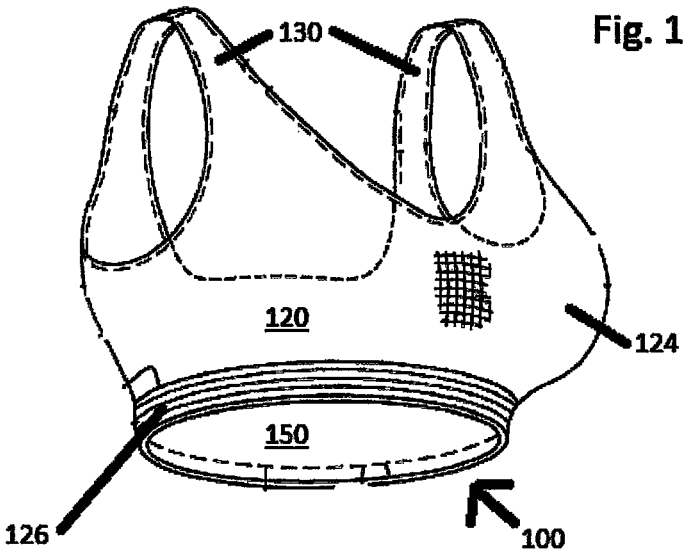
FIG. 1 is a perspective view of an exemplary upper torso garment according to this disclosure.

Turning to the figures, FIG. 1 shows an exemplary upper torso garment 100 having a torso encircling band 126. The upper torso garment 100 generally comprises an outer fabric layer 120 and an inner fabric layer 150 connected together by the band 126. Alternatively, the upper torso garment 100 may be comprised of a single layer of fabric. The outer layer 120, band 126 and inner layer 150 may be formed on a conventional circular knitting machine, resulting in a tubular knit form. The tubular knit form is then folded in order to create the outer layer 120 and the inner layer 150. As a result the band 126 will also have a dual layer construction. The band 126 can preferably have a length (as a loop) of between about 10 inches and about 18 inches when relaxed. The band 126 can be made available in a variety of lengths to accommodate users of all sizes. The band 126 can be capable of having a stretched length two times or more the relaxed length. This stretch will provide the necessary support as well as accommodate a range of wearers' sizes. The band 126 can preferably have a width between about 0.25 inches and about 2.0 inches. It may be preferable to provide a wider band 126 with a larger garment 100, thereby providing increased support. The resulting two-ply band 126 can have a thickness of approximately ⅛ of an inch. The upper torso garment 100 further comprises at least one front breast covering portion 124, and a pair of straps 130.

Figure 2:
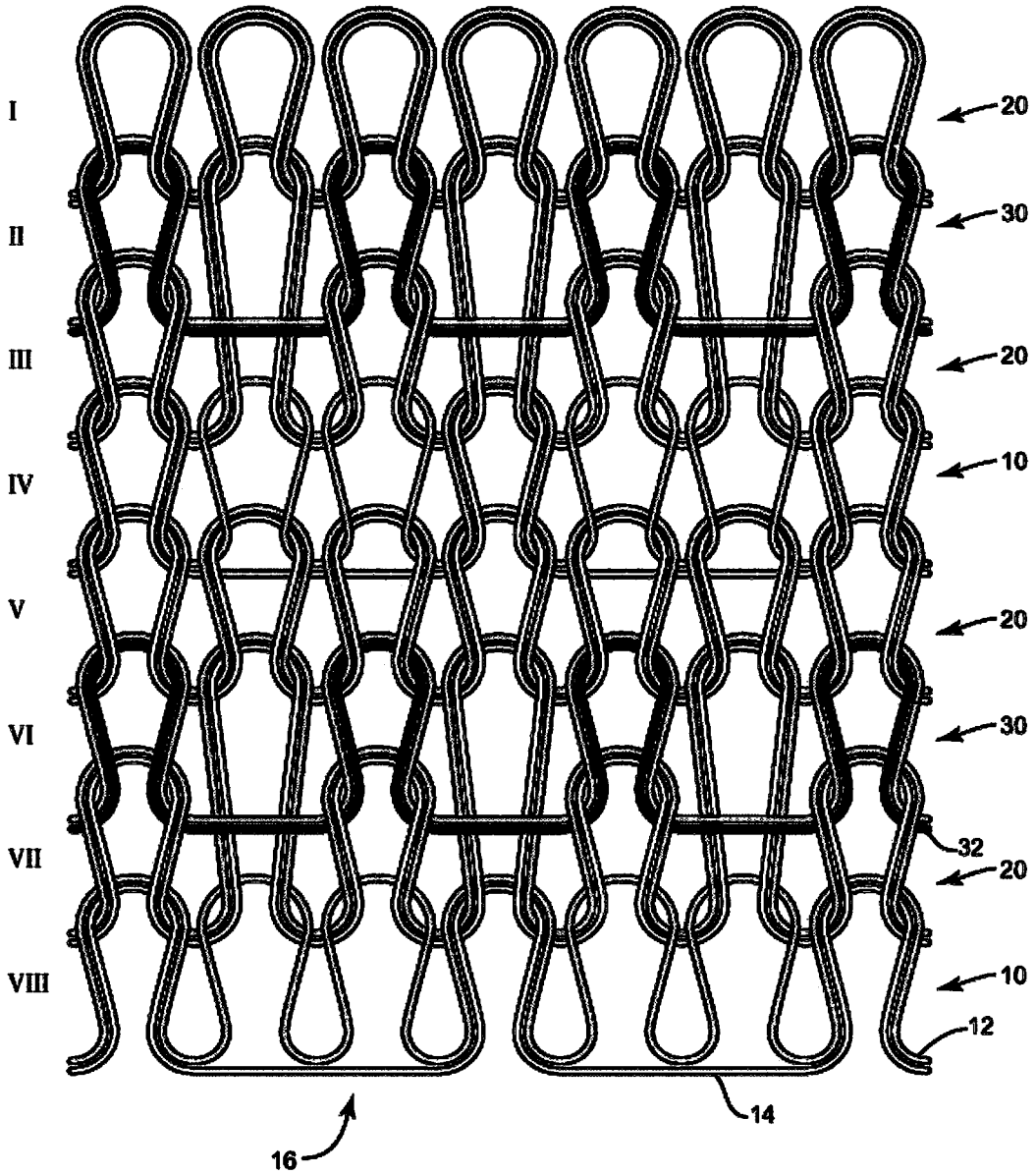
FIG. 2 is a diagrammatic view of the knit structure of the improved band according to this disclosure.

The band 126 will be discussed in more detail in view of FIG. 2. The band 126 of the present disclosure may comprise a series of first courses 10. Each of the first courses 10 comprises a first yarn 12 and a second yarn 14. In a preferred embodiment, the first yarn 12 includes a covered spandex. The second yarn 14 comprises a low friction yarn. Examples of low friction yarns include nylon, polyester, polypropylene and rayon. The second yarn 14 is float platted with the first yarn 12 in the series of first courses 10. The first 12 yarn and second 14 yarn are platted in that they are both fed into a single course. The second yarn 14 is float platted in that the second yarn 14 is floated over select wales and knit at select wales in a predetermined pattern independent from the knitting pattern of the first yarn 12. In an exemplary embodiment, the first yarn 12 is jersey knit with plain stitches at every wale.

The pattern of knitting and floating of the second yarn 14 can include a variety of patterns, ranging from 1×1 where the second yarn 14 alternates being knit at one wale and floated past one wale; to 2×4 where the second yarn 14 is knit at two consecutive wales and then floated over four consecutive wales. In a preferred embodiment, a 1×2 pattern is used, knitting at one wale followed by a float past two wales.

By floating the second yarn 14 over a portion of the wales, less material becomes bound up in the band 126 as compared to a band having each yarn knit at each wale. This reduced amount of material decreases the bulk in the band 126 leading to an increased degree of comfort. Comfort is also increased by using floats 16 made from the low friction second yarn 14 contacting the skin as compared to the prior art. The prior art increased friction between the garment and the wearer by using floats formed from exposed elastic yarns. These yarns provided the desired high degree of friction, but this friction also increases discomfort and chaffing.

The band 126 of the present disclosure may also comprise a series of second courses 20. The second courses 20 also include the first, covered elastomeric, yarn 12 and the second, low friction, yarn 14. Therefore each of the second courses 20 also includes the first yarn 12 platted with a second yarn 14. The second courses 20 are distinct from the first courses 10 in that the first and second yarns 12, 14 of the second courses 20 are knit with the same pattern. The pattern of the second courses 20 may be jersey, where the yarns are knitted into plain knit stitches at each wale.

The band 126 of the present disclosure may also comprise a series of third courses 30. The third courses 30 include the first, covered elastomeric, yarn 12 and a third yarn 32. The third yarn 32 comprises a high friction yarn, such as an uncovered elastic yarn. In a preferred embodiment, the first yarn 12 and the third yarn 32 of the third courses 30 are platted together and follow the same pattern throughout the course. In a preferred embodiment, the first yarn 12 and the third yarn 32 are knit into plain knit stitches on every other wale and float knit stitches on every other wale. Alternatively, the third courses 30 may comprise all plain knit stitches.

In an exemplary embodiment, the band 126 is formed on a circular knitting machine having a set or multiple of eight feeds. As a result, eight courses will be knit with each revolution of the machine. Courses one through eight are labeled I-VIII in FIG. 2. In this exemplary embodiment feeds IV and VIII will be first courses 10, feeds II and VI will be third courses 30 and the remainder will be second courses 20. This provides the preferred ratio of first to second to third courses of 1:2:1. It should also be noted that the like courses have been symmetrically separated among the eight courses I-VIII. This symmetry will provide a more consistent and comfortable band 126. The resulting band 126 can have approximately 4% weight of the first, covered elastomeric, yarn 12, approximately 88% weight of the second, low friction, yarn 14, and approximately 8% weight of the third, high friction, yarn 32. Changes in the specific material used for each yarn 12, 14, 32 will slightly adjust the percentage by weight of each yarn.

The floats 16 of second, low friction, yarn 14 combined with the reduction or elimination of skin contact with the uncovered elastic yarn 32 has increased the comfort and feel of the upper torso garment 100, but may also have the effect of increasing the slippage of the garment 100. In order to compensate for this slippage, the band 126 can be "tightened" by shortening the stitch length of knitted stitches. This will provide the resistance to stretch necessary to provide satisfactory anchoring, while maintaining the improved comfort due to the reduction in friction relative to the prior art.

Figure 3:
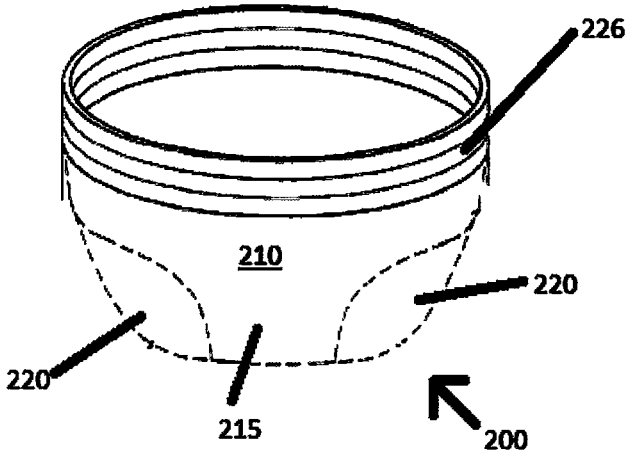
FIG. 3 is a perspective view of an exemplary lower torso garment according to this disclosure.

FIG. 3 shows an exemplary lower torso garment 200 according to the present disclosure. The lower torso garment 200 includes a body portion 210, the body portion 210 forming a crotch area 215 and a pair of leg openings 220. The top of the lower torso garment 200 includes a band 226. The lower torso band 226 includes all of the features discussed above with respect to the upper torso band 126. The band 226 may be formed as a turned welt, created on conventional circular knitting machines and result in a dual layer band.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. An upper torso garment, comprising:
- a circularly knitted body, the circularly knitted body having:
- a torso encircling band disposed at a lower portion of the circularly knit body, the torso encircling band comprising:
  - a first series of courses, the first series of courses comprising:
    - a first yarn, the first yarn comprising a covered elastomeric yarn knit in a first pattern; and
    - a second yarn, the second yarn being a low friction yarn; and
  - wherein the second yarn is platted with the first yarn in a second pattern different from the first pattern, the second pattern comprising floats across at least one wale of the torso encircling band.

2. The upper torso garment according to claim 1, wherein the covered elastomeric yarn is covered spandex.

3. The upper torso garment according to claim 1, wherein the low friction yarn is one of nylon, polyester, polypropylene and rayon.

4. The upper torso garment according to claim 1, wherein the first yarn is knitted into plain knit stitches on every wale.

5. The upper torso garment according to claim 1, wherein the second yarn is knitted into plain knit stitches on one wale and float platted over two wales.

6. The upper torso garment according to claim 1, wherein the band further comprises:
- a second series of courses, the second series of courses comprising:
  - the first yarn;
  - the second yarn; and
  - the first and second yarns being knitted into plain knit stitches on every wale.

7. The upper torso garment according to claim 6, wherein the band comprises one first series of courses for every two second series of courses.

8. The upper torso garment according to claim 6, wherein the band further comprises:
- a third series of courses, the third series of courses comprising:
  - the first yarn;
  - a third yarn, the third yarn comprising a high friction yarn; and the first and second yarns being knit into plain knit stitches on every other wale and float knit stitches on every other wale.

9. The upper torso garment according to claim 8, wherein the third yarn comprises an uncovered elastic yarn.

10. The upper torso garment according to claim 8, wherein the band comprises one of the first series of courses for every one of the series of third courses.

11. The upper torso garment according to claim 8, wherein the band comprises one of the first series of courses for every two of the second series of courses.

12. The upper torso garment according to claim 8, wherein adjacent courses are not from the same series of courses.

13. The upper torso garment according to claim 1, wherein the band is comprised of a turned welt.

14. The upper torso garment of claim 1, wherein the circularly knitted body comprises:

at least one front breast covering portion; and a pair of shoulder straps.

15. The upper torso garment according to claim 14, wherein the upper torso garment is a brassiere, a sports brassiere, or a camisole.

16. The upper torso garment of claim 1, wherein a width of the torso encircling band is between 0.25 inches and 2 inches.

17. The upper torso garment of claim 1, wherein a thickness of the torso encircling band is about ⅛ inches.

18. The upper torso garment of claim 1, wherein the band further comprises:

a third series of courses, the third series of courses comprising:

the first yarn; and a third yarn; and wherein, in each of the third series of courses, the first and third yarns are knit into plain knit stitches on every other wale of the band and knit into float knit stitches on a remainder of the wales of the band.

19. The upper torso garment of claim 18, wherein the third yarn comprises at least one of a high friction yarn or an uncovered elastic yarn.

20. The upper torso garment of claim 18, wherein the band comprises one of the first series of courses for every one of the third series of courses.

* * * * *